US005553796A

United States Patent [19]

Bettenworth

[11] Patent Number: 5,553,796

[45] Date of Patent: Sep. 10, 1996

[54] ROLLER MILL

[75] Inventor: Jörg Bettenworth, Ennigerloh, Germany

[73] Assignee: Krupp Polysius AG, Beckum, Germany

[21] Appl. No.: 370,640

[22] Filed: Jan. 10, 1995

[30] Foreign Application Priority Data

Feb. 14, 1994 [DE] Germany ..... 44 04 634.0

[51] Int. Cl.[6] ..... B02C 4/02; B02C 4/32

[52] U.S. Cl. ..... 241/230; 241/232; 241/234

[58] Field of Search ..... 241/230, 231, 241/232, 233, 234

[56] References Cited

U.S. PATENT DOCUMENTS 4,880,172 11/1989 Heinemann et al. ..... 241/101.2

5,005,775 4/1991 Jakobs ..... 241/232

5,060,874 10/1991 Sidney, Jr. et al. ..... 241/231

5,192,030 3/1993 Jakobs ..... 241/101.2

*Primary Examiner*—John Husar

*Attorney, Agent, or Firm*—Learman & McCulloch

[57] ABSTRACT

A roller mill having a fixed roller and a floating roller mounted on a frame and driven in opposite directions includes two gear units for the rollers and two independent torque absorbers to minimize the transfer of torque loads to the frame. Each torque absorber has a pair of two arm levers pivoted at spaced axes on the frame so that one end of each lever is adjacent one end of the other. A first force transmitting member couples the adjacent ends of the levers to each other and a second force transmitting member couples the opposite ends of the levers to the associated gear unit.

13 Claims, 2 Drawing Sheets

ROLLER MILL

BACKGROUND OF THE INVENTION

The invention relates to a roller mill, particularly a material bed roller mill. Roller mills of this type, which are also designated as double-roller mills, are well known in the art. In these roller mills the torques of the gear units or gear cases set onto the shafts of the two rollers must be supported in an appropriate manner with respect to a mill base or machine frame in which the rollers are rotatably mounted by way of their shafts.

For these roller mills which are known in the art a support arrangement has already been proposed in order to take up the torque occurring between the gear cases of the two rolls and the machine frame in such a way that both gear cases are supported against one another with a torsion bar interposed and any residual torque resulting from a possible difference in the two torques is supported by way of the fixed roller on the machine frame. In the design of this one-armed torque support four times the nominal value is generally set as the maximum value for this differential torque. In the practical implementation it should be noted that a one-armed torque support introduces transverse forces into the shaft of the fixed roller by way of the appertaining gear unit. Accordingly, in the case of particularly high driving torques, such as frequently occur in the case of so-called "material bed roller mills", high transverse force loads are produced in the connection between the gear unit and the shaft.

Furthermore, in these known roller mills it should be noted that in the course of operation the circumferential surface (working surface) of the roller is subjected to considerable wear by abrasion when very abrasive materials are treated and accordingly—in order to maintain a predetermined grinding gap between the two rollers—the floating roller must be pushed in the machine frame in the direction of the fixed roller, and these displacements of the floating roller must be compensated by a corresponding turning of the torsion bar between the gear cases of the two rollers. However, this latter becomes all the more difficult as the wear paths become greater. Assistance can, however, be provided here for example with the aid of correspondingly long or extensible eccentric levers, but this leads to higher torsional moments, with the consequence that the torque support becomes correspondingly weaker or that a correspondingly more costly reinforcement is provided.

SUMMARY OF THE INVENTION

The object of the invention, therefore, is to create a roller mill, particularly a material bed roller mill, by means of which, even with relatively high strain forces and with comparatively long displacement paths of the floating roller due to wear, an extremely reliable torque support which is substantially free of transverse forces is ensured with respect to the appertaining roller shaft.

In contrast to the known construction described above, in the roller mill according to the invention each gear case is supported by a separate torque support arrangement (independent of the other gear case) relative to the machine frame. In this case at least the torque support arrangement for the gear unit on the floating roller is constructed approximately in the form of a coupling gear. This coupling gear contains two two-armed levers which are each mounted on the machine frame so as to be pivotable on a stationary axis of rotation and are each connected in an articulated manner on the one hand by way of their first, outer lever arms to upper and lower articulation points of the Sear case (for the appertaining roller) which lie opposite one another and on the other hand by way of their inner second lever arms, which are adjacent and point approximately towards one another, to a rigid coupling or force transmitting member. By this type of gear support in the form of a coupling gear each gear unit or each Sear case can be supported by itself—with respect to the torque occurring—on the machine frame, so that the two rollers can only be influenced by way of the material for grinding comminuted between them. A particular advantage of such coupling gears may be seen in the fact that the torque support arrangement formed there remains largely unaffected even in the case of relatively large wear paths on the part of the floating roller. In this case all the points of application of force in this coupling gear lie in approximately one plane, which is advantageous above all for the flux of force in this coupling gear. Each housing of the rollers which is connected to the machine frame by such a coupling gear can be supported practically without transverse force with respect to the appertaining roller shaft.

Since in this construction according to the invention the rigid coupling member of each coupling gear rigidly connects the two inner second lever arms of the two levers, this coupling member is under tensile load during the torque support by the corresponding rotary movements of the levers, so that a further rotary movement of the lever is prevented and thereby the torque to be supported is introduced into the machine frame by way of the fixed axes of rotation.

In general it will be preferred in this case for the torque support arrangement for the gear case of the fixed roller to be constructed in the form of a second coupling gear which is disposed between this gear case and the machine frame in a similar manner to the first coupling gear for the floating roller, but is supported independently of this first coupling gear.

However, it is generally also possible in many cases for the torque support arrangement for the gear case of the fixed roller to be constructed substantially by an attachment like a lever arm on this gear case, which attachment is supported directly—preferably by articulation—on the machine frame.

If in the roller mill according to the invention the torque support arrangement for the fixed roller or the gears thereof is likewise formed by a coupling gear, then a support which is completely free of transverse force is thereby ensured because this support system can adapt thereto by itself. On the other hand, in the case of a direct connection for example of support attachments like lever arms on the machine frame the supporting forces in the support arms or support attachments can be unequal, so that transverse forces are to be expected.

THE DRAWINGS

The invention will be explained below with the aid of the drawings. These drawings have been kept largely schematic, and in them FIG. 1 shows a perspective view of the roller mill according to the invention in the form of a material bed roller mill;

FIG. 2 shows a side view of the roller mill onto the outer long side equipped with the gears.

DETAILED DESCRIPTION

Figure 1:
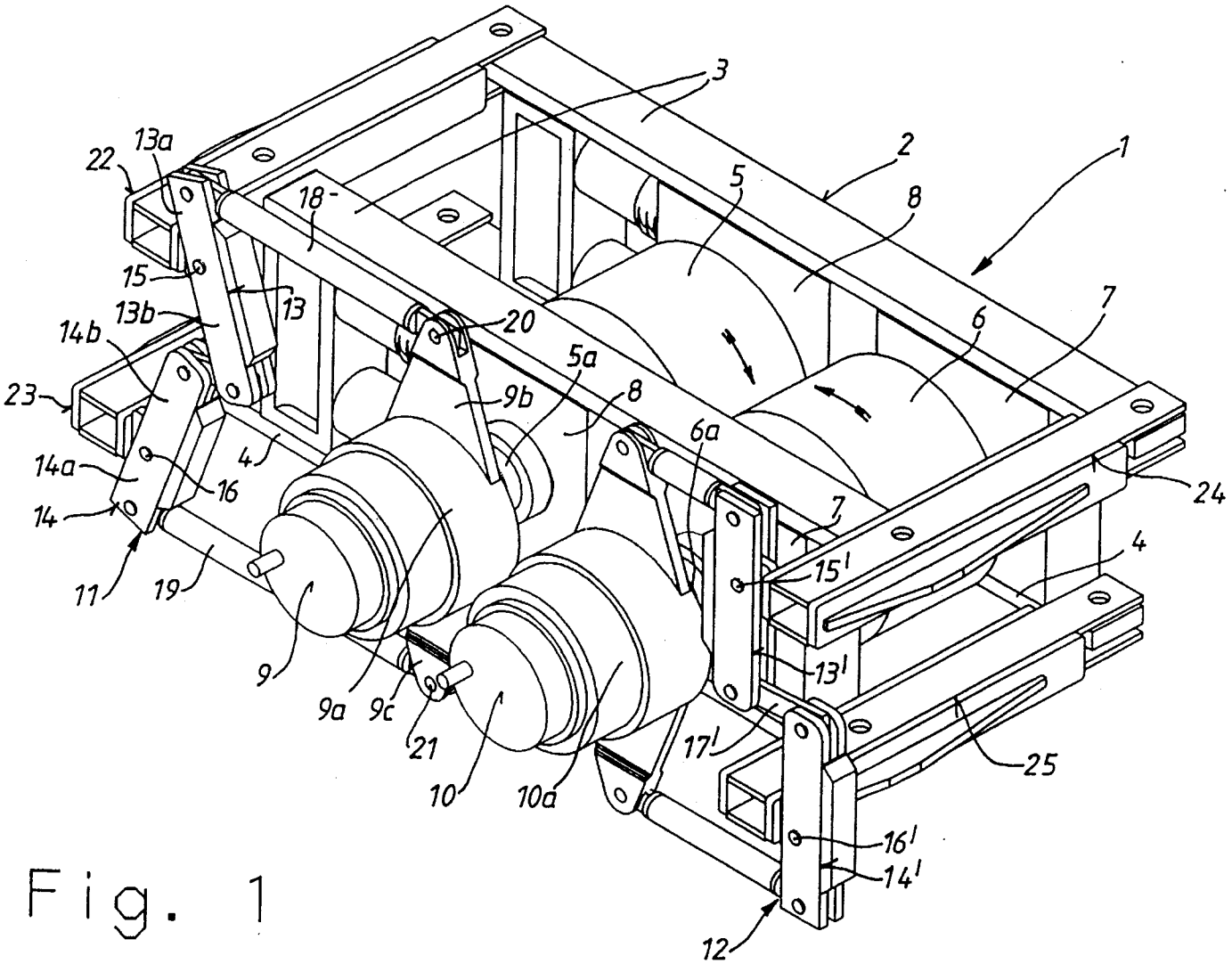

The embodiment of the material bed roller mill 1 according to the invention which is illustrated in the drawings will first of all be explained in its general construction particularly with the aid of FIG. 1 (perspective view).

This material bed roller mill 1 comprises in the usual way a machine frame 2 with upper chords 3 and lower chords 4 extending in the longitudinal direction. In this machine frame 2 there are disposed—likewise in a manner which is known per se—two rollers 5, 6 which can be driven in opposite directions and are pressed against one another with relatively high pressure, of which one roller is constructed as a fixed roller 6 and the other as a floating roller 5 which is movable in the machine frame 2 in the direction of the fixed roller 6. In this case the fixed roller 6 is mounted at both ends in the machine frame 2 by way of its shaft 6*a* in fixed bearing jewels 7 and this floating roller 5 is mounted at both ends in the machine frame 2 by way of its shaft 5*a* in floating bearing jewels 8.

On one outer long side of the machine frame 2 (in FIG. 1 on the outer long side facing the observer) the roller mill 1 contains two gear units 9 and 10 respectively which are set, in the present case flanged, onto the shafts 5*a*, 6*a* of the two rollers 5, 6, and above all the cases 9*a* and 10*a* respectively of these gear units can be seen.

Each gear case 9*a*, 10*a* has associated with it a separate torque absorber mechanism 11, 12 respectively in order in each case to take up the torque occurring between the appertaining gear case 9*a* or 10*a* and the machine frame 2 and to be able to support it relative to the machine frame 2. At least the torque support arrangement 11 for the gear case 9*a* of the floating roller 5, but in the illustrated embodiment preferably both torque support arrangements 11 and 12 for the gear cases 9*a*, 10*a* on the floating roller 5 and on the fixed roller 6, are constructed approximately in the form of a coupling gear. Each coupling gear 11, 12 provided according to the invention has two two-armed levers 13, 14 or 13', 14' respectively, which are mounted between their ends on stationary axes of rotation 15, 16 or 15', 16' respectively so as to be pivotable on the machine frame 2.

Since the second coupling gear 12 for the gear case 10*a* of the fixed roller 6 is constructed and disposed in principle in the same way as the first coupling gear 11 for the floating roller 5, for the sake of simplicity and greater clarity only the first coupling gear 11 for the gear case 9*a* of the floating roller will be explained in greater detail as regards its construction and its function (the same then applies accordingly and in an adapted manner to the second coupling gear 12).

This first coupling gear 11 or each coupling gear contains in addition to the two two-armed levers 13, 14 a substantially rigid first force transmitting or coupling member 17 as well as two substantially rigid force transmitting tie rods 18, 19. The two two-armed levers 13, 14 of the coupling gear 11 are in each case connected in an articulated manner by way of their first lever arms 13*a* or 14*a* as well as by way of the appertaining upper and lower connecting rod 18 or 19 to upper and lower articulation points 20, 21, which lie opposite one another, of the gear case 9*a* and on the other hand by way of their second lever arms 13*b*, 14*b*, which are adjacent and, point approximately towards one another, to the rigid coupling member 17. Advantageously each gear case 9*a*, 10*a* connected to a coupling gear 11, 12 has fixed to it a first attachment 9*b* which is directed upwards like a lever arm and also fixed to it a second attachment 9*c* which is directed downwards like a lever arm. In this case the two articulation points 20 or 21 of the gear case, in this case the gear case 9*a*, are in each case machined in a corresponding manner into the radially outer ends, that is to say into the upwardly or downwardly directed free ends of these two attachments 9*b* or 10*c* of the appertaining housing 9*a*, preferably in such a way that the upper and lower articulation points 20, 21 lie diametrically opposite one another. Accordingly the upper first tie rod 18 of the first coupling gear 11 under consideration extends in the region of an upper chord 3 of the machine frame 2 and is connected with one end in an articulated manner to the appertaining upper articulation point 20 and with its other end is connected in an articulated manner to the free end of the upwardly directed first lever arm 13*a*, whilst the lower second tie rod 19 extends in the region of a lower chord 4 of the machine frame 2 and is connected in an articulated manner on the one hand to the downwardly directed first lever arm 14*a* of the lower second lever 14 and on the other hand to the lower second articulation point 21 of the appertaining gear unit 9*a*. If in the aforementioned construction the first and second attachments 9*b* and 9*c* of the gear case 9*a* (or of each gear case) are substantially directed approximately radially and vertically upwards or downwards and accordingly the upper and lower articulation points 20 or 21 machined into their free ends lie diametrically opposite one another on an approximately vertical line—as indicated by broken lines in FIG. 2—then even in the case of certain deflection movements of the attachments 9*b*, 9*c* in the peripheral direction these will not reach into the region above and below the neighbouring gear case (e.g. 10*a*). In this way the minimum spacing of the two rollers 5, 6 in the present case is only determined by the size or diameter of the gear case, i.e. a particularly compact construction and arrangement is produced for each coupling gear, so that it can be disposed particularly favourably on the outer long side of the machine frame 2 on which the gear units 9, 10 for driving the rollers are also located.

The size and construction of the levers 13, 14 or 13', 14' will in general depend upon the size of the roller mill and the size of the machine frame 2 and the rollers or the gear unit driving them. Accordingly the two-armed levers 13, 14 or 13', 14' can be constructed quite generally as levers with lever arms of equal lengths or with lever arms of unequal lengths, according to the most convenient construction and arrangement of the coupling gear on the machine frame.

Figure 2:
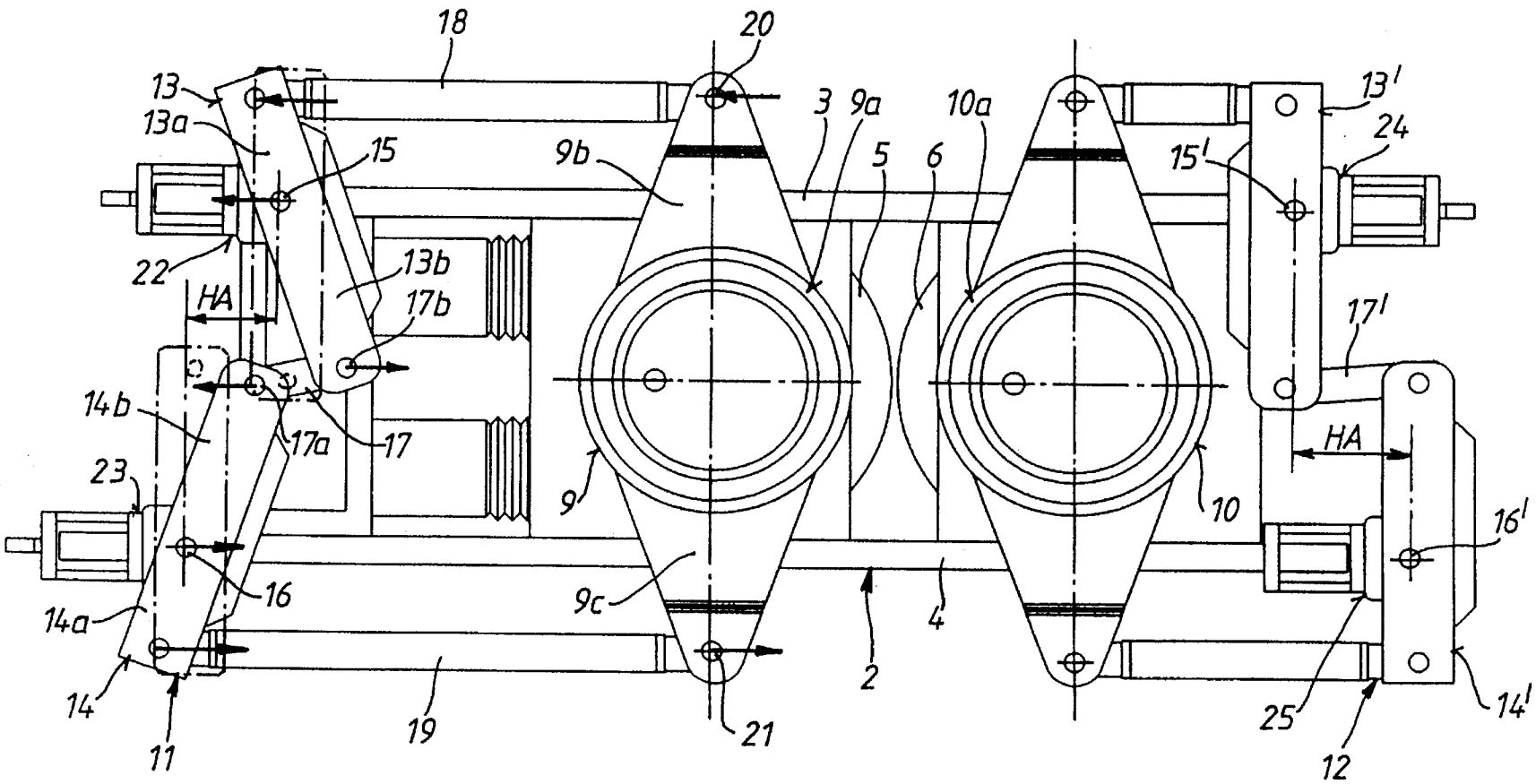

In the embodiment illustrated in FIGS. 1 and 2 the two levers 13, 14 or 13', 14' of each coupling gear 11, 12 are constructed as levers with unequal arms, of which the first lever arms 13*a*, 14*a* which are directed upwards or downwards and are connected to the tie rods 18, 19 are shorter than their second lever arms 13*b*, 14*b* which point towards one another and are connected to one another by the coupling member 17, 17'.

In each coupling gear 11, 12 it is also advantageous for the length and arrangement of the second lever arms, e.g. the two lever arms 13*b* and 14*b* of the two levers 13, 14 of the first coupling gear 11, as well as the length of the appertaining coupling member 17 or 17' to be chosen in such a way that the coupling member 17, 17' is subjected predominantly to horizontal tractive forces so that vertical forces can be kept as low as possible. This is particularly important in the case of the first coupling gear 11 which is co-ordinated with the gear unit 9 or the appertaining gear case 9*a* of the floating roller 5 in so far as the said operational state (as regards the tractive forces) should also be largely maintained in the various displaced positions of the floating roller 5 due to wear and of the appertaining gear unit 9.

Accordingly, in the illustrated embodiment the stationary axes of rotation 15, 16 or 15', 16' of both coupling gears 11, 12—viewed in plan, but also to be seen in FIG. 2—are disposed with such a horizontal spacing HA from one another on the machine frame 2 that the lever arms, e.g. 13*b*, 14*b*, which point towards one another, of both levers 13, 14 or 13', 14' of the two coupling gears 11, 12 overlap or project beyond one another with their articulated connections, e.g. 17*a*, 17*b*, to the appertaining coupling member 17 or 17' at least in their vertical or in their approximately vertical position, as is indicated in FIG. 2 by dash-dot lines on the coupling gear 11 and by solid lines on the coupling gear 12.

If in the case of the last mentioned construction and assembly, the levers 13, 14 of the first coupling gear 11 for the gear unit 9 of the floating roller 5 are considered (particularly in the representation in FIG. 2), then it can be easily imagined that in the case of unworn rollers 5, 6 the second lever arms 13*b* and 14*b*—in FIG. 2—are pivoted furthest towards the right, at approximately half the wear path they substantially stand approximately vertical (as indicated by dash-dot lines) and with maximum wear of the rollers and thus at the full wear path they are pivoted to the left. Accordingly from the starting position of the floating roller 6 (in the case of unworn rollers) to the maximum wear path (rollers worn to the maximum) the two second lever arms 13*b* and 14*b* and with them the coupling member 17 will gradually pivot overall towards the left, and in the starting state the coupling member has a slightly inclined position relative to the horizontal because of the described length ratios of the lever arms 13*b*, 14*b*; after covering approximately a quarter of the wear path of the floating roller the coupling member 17 will lie approximately horizontal; after half of the wear path the coupling member 17 then again takes up an inclined position to the horizontal; after three-quarters of the wear path the coupling member 17 again goes into a horizontal position, whereas when it reaches the maximum wear path it again takes up an inclined position. Because of the second lever arms 13*b* and 14*b* which overlap in their length (as described above), in the particular inclined position of the coupling member 17 a relatively small angle of inclination is produced with respect to the horizontal. By contrast, if the lever arms 13*b* and 14*b* of the two levers 13, 14 were of precisely such a length that they are aligned approximately vertically at half the wear path and the coupling member 17 connected between them is aligned horizontally, then this would also mean that predominantly horizontal tractive forces are exerted on the coupling member 17, but that this coupling member would have a markedly steeper inclination with respect to the horizontal in the starting position of the floating roller and after the maximum wear path, with the consequence of correspondingly greater vertical forces.

As a particularly simple design each coupling member 7, 17' can be constructed approximately in the form of a rigid flat connecting link. As can also be seen particularly clearly in FIG. 1, in both coupling gears 11, 12 all articulated connections can be constructed extremely simply, approximately in the form of claw-like plate Joints with plain bearings.

In order that a particularly favourable and reliable connection or fixing facility can be produced for the fixed axes of rotation 15, 16, 15', 16' on the machine frame 2, for each of these stationary axes of rotation a crosspiece 22, 23, 24 25 is provided which is fixed approximately on the end face on the machine frame 2. Accordingly for the first coupling gear 11 for the axis of rotation 15 of the upper first lever arm 13 the crosspiece 22 is fixed in the region of the upper chord 3 and for the axis of rotation 16 of the lower second lever 14 the crosspiece 23 is fixed in the region of the lower chord 4. For the Second coupling gear 12, for the axis of rotation 15' of the upper first lever 13' the crosspiece 24 and for the axis of rotation 16' of the lower second lever 14' the crosspiece 25 is fixed in the region of the lower chord 4 of the machine frame 2. The fixing of the crosspieces on the upper and lower chords 3, 4 can preferably be carried out by means of bolts. As a result only tractive or compressive forces and no bending moments are introduced into the said chords of the machine frame.

If in the side view according to FIG. 2 the flux of force for example on the left-hand first coupling gear 11 is considered on the assumption that a left-rotating torque is to be supported with respect to the machine frame, then the force directions indicated by arrows are produced in the various articulation points or connecting joints. Accordingly the upper tie rod 18 introduces compressive forces into the upwardly directed first lever arm 13*a* of the upper first lever 13, resulting in the tendency for this lever 13—in FIG. 2—to rotate towards the left. At the same time tractive forces are introduced into the downwardly directed first lever arm 14*a* of the lower second lever 14 by the lower tie rod 19, resulting in the tendency for this lower second lever 14 likewise—according to FIG. 2—to rotate towards the left. In this way the two second lever arms 13*b* and 14*b*, which point towards one another, of the two levers 13 and 14 respectively tend to move away from one another. However, this is prevented by the rigid coupling member 17 disposed between these two lever arms 13*b* and 14*b*. In this way the described torque is introduced into the two stationary axes of rotation 15 and 16 and accordingly by way of the appertaining crosspieces 22, 23 into the stationary machine frame 2, so that a reliable torque support is ensured. Thus both coupling gears 11, 12 which operate in the same way in principle can independently of one another introduce into the machine frame the torques occurring on their appertaining gear cases 9*a* or 10*a*.

In particular when considering the side view in FIG. 2 it is easy to imagine that after roller wear on any scale and with a correspondingly large displacement path of the floating roller 5 towards the right (against the fixed roller 6) only the position of the two two-armed levers 13, 14 is changed somewhat (by corresponding pivoting of the second lever arms 13*b*, 14*b* in FIG. 2 towards the left), but without anything changing on the extremely reliable torque support by way of the appertaining coupling gear 11.

I claim:

1. A roller mill construction comprising a frame; a pair of rollers mounted on said frame for relative linear movements toward and away from each other and for rotation in opposite directions relative to said frame; a pair of gear units operatively coupling said rollers for imparting rotation to one roller in response to rotation of the other; and first torque absorbing means associated with at least one of said rollers for absorbing rotational torque loads and minimizing transfer of such loads to said frame, said first torque absorbing means comprising a pair of two armed levers pivoted on said frame for rotation about spaced apart axes between opposite ends of the respective levers, one end of one of said levers occupying a position adjacent one end of the other of said levers, first force transmitting means pivotally coupling the adjacent ends of said levers to one another and second force transmitting means coupling the other ends of said levers at spaced points to the gear unit of said one of said rollers.

2. The construction according to claim 1 wherein the adjacent ends of said levers are laterally offset from one another.

3. The construction according to claim 2 wherein said adjacent ends of said levers project beyond each other.

4. The construction according to claim 1 including second torque absorbing means associated with the other of said rollers and corresponding in construction and operation to said first torque absorbing means.

5. The construction according to claim 4 wherein said first and second torque absorbing means are independent of one another.

6. The construction according to claim 5 wherein the gear unit associated with each of said rollers has a pair of flanges extending therefrom in diametrically opposed opposite directions and wherein said second force transmitting means is coupled to the flanges of the associated gear unit.

7. The construction according to claim 1 wherein one arm of each of said two arm levers is longer in length than the other arm thereof.

8. The construction according to claim 7 wherein said first force transmitting means couples the adjacent ends of the longer of said arms to one another.

9. The construction according to claim 1 wherein said levers are substantially coplanar.

10. The construction according to claim 1 wherein said axes are vertically spaced and offset laterally from one another.

11. A material bed roll mill construction comprising:

a frame;

first and second rollers journalled by shafts thereof on said frame for rotation of said rollers in opposite directions relative to said frame about axes of said shafts, one of said rollers being fixed by said frame against linear movement and the other of said rollers being supported for selective linear movement toward and away from said one roller;

a pair of drive gear units mounted on said shafts of said fixed and movable rollers, respectively, for driving said rollers in opposite directions about the axes of said shafts, said drive gear units each having a gear case transmitting torsion loads generated by said drive gear units as a result of driving said rollers; and separate first and second torsion absorbing means coupling said gear cases of said movable and fixed rollers, respectively, to said frame for absorbing and minimizing the transfer of such torsion loads to said frame, at least said gear case of said movable roller including opposed articulation arms, and at least said first torsion absorbing means comprising a pair of two-armed levers pivoted about spaced apart axes on said frame between opposite ends of said levers such that one end of one of said levers occupies a position adjacent one end of the other of said levers, first force-transmitting means coupling the adjacent ends of said levers to one another, and second force-transmitting means coupling the other ends of said levers to said articulation arms of said gear case.

12. The construction of claim 11 wherein said first rigid force transmitting means comprises a rigid coupling member.

13. The construction of claim 12 wherein said second force transmitting means comprises a pair of rigid tie rods.

* * * * *